US009745675B2

(12) United States Patent
Herrmann et al.

(10) Patent No.: US 9,745,675 B2
(45) Date of Patent: Aug. 29, 2017

(54) HEDDLE FOR LOOM, LOOM EQUIPPED WITH SUCH A HEDDLE AND PROCESS FOR MANUFACTURING SUCH A HEDDLE

(71) Applicant: Staubli Lyon, Chassieu (FR)

(72) Inventors: Michel Herrmann, Fontaines sur Saone (FR); Philippe Gaubert, Chassieu (FR); Damien Bouchet, Chaponnay (FR)

(73) Assignee: STAUBLI LYON, Chassieu (FR)

( * ) Notice: Subject to any disclaimer, the term of this patent is extended or adjusted under 35 U.S.C. 154(b) by 0 days.

(21) Appl. No.: 14/875,837

(22) Filed: Oct. 6, 2015

(65) Prior Publication Data

US 2016/0108561 A1 Apr. 21, 2016

(30) Foreign Application Priority Data

Oct. 16, 2014 (FR) ..... 14 59958

(51) Int. Cl.

| | |
|---|---|
| ***D03C 9/04*** | (2006.01) |
| ***D03C 9/02*** | (2006.01) |
| ***D03C 3/40*** | (2006.01) |
| *D03C 9/00* | (2006.01) |

(52) U.S. Cl.

CPC ..... *D03C 9/024* (2013.01); *D03C 3/40* (2013.01); *D03C 9/02* (2013.01); *D03C 9/026* (2013.01)

(58) Field of Classification Search

CPC ..... D03C 9/024; D03C 9/02; D03C 9/0633

See application file for complete search history.

(56) References Cited

U.S. PATENT DOCUMENTS

| | | | | |
|---|---|---|---|---|
| 4,088,158 | A * | 5/1978 | Kennedy | D03C 9/0633 139/92 |
| 4,355,665 | A * | 10/1982 | Ramseier | D03C 9/028 139/96 |
| 4,383,557 | A * | 5/1983 | Graf | D03C 9/02 139/93 |
| 6,283,163 | B1 * | 9/2001 | Kagi | D03C 9/028 139/93 |
| 7,464,730 | B2 * | 12/2008 | Mettler | D03C 9/02 139/59 |
| 2004/0168735 | A1 * | 9/2004 | Bauder | D03C 3/44 139/59 |
| 2005/0061384 | A1 * | 3/2005 | Holly | D03C 9/02 139/91 |

(Continued)

FOREIGN PATENT DOCUMENTS

| | | |
|---|---|---|
| CN | 201228305 | 4/2009 |
| EP | 1908863 | 4/2008 |
| EP | 2166138 | 3/2010 |

*Primary Examiner* — Bobby Muromoto, Jr.
(74) *Attorney, Agent, or Firm* — Dowell & Dowell, PC

(57) ABSTRACT

A heddle for guiding a warp yarn for a loom extends lengthwise along a longitudinal axis (X1) and has a heddle body including at least one strand and at least one eye including an eyelet for the passage of the warp yarn and wherein the heddle body includes at least one housing, the housing of the eye and the housing of the heddle body extend along a common axis (Z1) transverse to the longitudinal axis, the housing of the heddle body is across from the housing of the eye, and the housings together forming a pair of housings and wherein an assembly member made from solidified resin is positioned in the pair of housings.

16 Claims, 13 Drawing Sheets

(56) References Cited

U.S. PATENT DOCUMENTS

| | | | | |
|---|---|---|---|---|
| 2007/0079887 | A1* | 4/2007 | Korbutt | D03C 9/02 139/93 |
| 2008/0083471 | A1* | 4/2008 | Mettler | D03C 9/024 139/93 |
| 2010/0084040 | A1 | 4/2010 | Stauss et al. | |

* cited by examiner

HEDDLE FOR LOOM, LOOM EQUIPPED WITH SUCH A HEDDLE AND PROCESS FOR MANUFACTURING SUCH A HEDDLE

BACKGROUND OF THE INVENTION

Field of the Invention

The invention relates to a heddle for guiding a warp yarn for a loom, as well as a loom equipped with such a heddle. The invention also relates to a method for manufacturing such a heddle.

Brief Description of the Related Art

A loom of the Jacquard type is equipped with a Jacquard mechanism to control several hooks. Each hook controls one or more arches. Each arch is connected to one end of a guide heddle for a warp yarn, which is connected by another end to the frame of the loom via a return spring. Each heddle is provided with an eyelet for passage of the warp yarn and is made up of an eye and a heddle body including two strands. These parts can be manufactured separately. The heddle is then called composite and requires assembly before its placement.

In this respect, it is known from EP-A-1,908,863 to use a heddle body manufactured from a plastic material and an eye made from ceramic or a hard metal. The heddle body is overmolded on the eye. This overmolding method generates burrs when the mold closes around the eye during the injection of the plastic material. The heddles must be gone over again by polishing to eliminate the burrs. Indeed, these burrs may destroy adjacent yarns when they rub on the heddle during weaving.

Furthermore, CN-Y-201228305 discloses a heddle which, in the embodiment of FIGS. 4 to 6, comprises a porcelain eye in which two through openings and four hollow zones are arranged. The strands of the heddle body are overmolded in these through openings and in these hollow zones. This overmolding creates the same problems as those mentioned above.

It is known, for example from EP-A-1,989,346, to use an eye provided at both of its ends with a longitudinal housing and two strands, each provided with an end having a smaller section. The end of a strand with a smaller section is inserted into the longitudinal housing of the eye, by nesting. The two parts are next assembled by gluing. Due to this nesting, it is difficult to guarantee a uniform glue seam, as well as good adherence of the glue. Furthermore, the engagement in a longitudinal housing limits the residual sections of the eye around the housing and the end sections of the strands. Thus, the assembly of the eyes and body of the heddle is not very strong.

The invention more particularly aims to resolve these drawbacks by proposing a composite heddle whereof the eye and the heddle body produce an assembly having a strong resistance to forces and a limited bulk.

SUMMARY OF THE INVENTION

In that spirit, the invention relates to a heddle for guiding a warp yarn for a loom, the heddle extending lengthwise along a longitudinal axis and comprising a heddle body including at least one strand. The heddle also comprises at least one eye at least one housing and an eyelet for passage of the warp yarn. According to the invention, the heddle body includes at least one housing, while the housing of the eye and the housing of the heddle body extend along a same axis transverse to the longitudinal axis. Furthermore, the housing of the heddle body is across from the housing of the eye, these two housings together forming a pair of housings, while an assembly member made from a solidified resin is positioned in the pair of housings.

Owing to the invention, the resin assembly member ensures a good transmission of longitudinal connecting forces between the eye and the heddle body, like rivets. In particular, the connecting forces can be transmitted by means of the resin assembly member in three directions: longitudinal, lateral and transverse. Furthermore, the resin assembly members have no clearance in the housings and do not bias the eye and the heddle body, during the placement and hardening of the resin.

According to advantageous but optional aspects of the invention, such a guide heddle may comprise one or more of the following features, considered in any technically allowable combination:

- The assembly member made from solidified resin forms an obstacle that secures the strand and the eye along the longitudinal axis and along an axis perpendicular to the longitudinal axis and the transverse axis.
- The housing of the heddle body and/or the housing of the eye crosses all away through the heddle body or the eye, along the transverse axis.
- The housing of the heddle body and/or the housing of the eye is a hole having a circular, oblong or polygonal section.
- At least one housing of the eye or the heddle body is a notch arranged on an edge of the eye or the heddle body.
- An assembly member of a first pair of housings forms a single piece with an assembly member of a second pair of housings, offset in the longitudinal direction relative to the first pair of housings.
- The eyelet crosses through the eye along the transverse axis and the assembly member forms a rivet made up of a resin body extending along the transverse axis and at least one head.
- The heddle comprises at least two pairs of housings distributed along the longitudinal axis and each housing a resin assembly member.
- All of the pairs of housings of the heddle emerge on a same side on the outside of the heddle.
- A portion of a first part, among the heddle body and the eye, is received in a receiving cavity arranged on the second part among the heddle body and the eye, while at least one housing, arranged on the second part for a resin assembly member, emerges in the receiving cavity or in a final portion that extends a bottom of the cavity in the direction of the longitudinal axis.
- The cavity arranged on the second part for receiving the portion of the first part is defined between two side walls, a bottom and a ceiling.
- At least the hollow body is made from a plastic material, preferably polyamide.
- The heddle includes a heddle body with two separate strands, and an eye, while one end of each strand comprises a receiving cavity defined at least between two side walls and bottom, as well as a final portion that extends the bottom in the direction of the longitudinal axis, a part with a reduced width of the eye being received in each cavity, and while a hole crossing through the final portion extending the bottom of each cavity is across from at least one through housing arranged on the eye to form a pair of housings for receiving a resin assembly member.

The invention also relates to a loom equipped with several guide heddles for a warp yarn. This loom is characterized in that at least one guide heddle is as mentioned above.

The invention also relates to a method for manufacturing a guide heddle comprising at least one strand with at least one housing and an eye with at least one housing. This method is characterized in that it comprises at least the following steps:

a)—positioning the eye relative to the strand, such that the housings of the eye are across from the housings of the strand and form at least one pair of housings;

b)—placing a quantity of liquid resin in the pair of housings;

c)—hardening of the resin in the pair of housings.

BRIEF DESCRIPTION OF THE SEVERAL VIEWS OF THE DRAWINGS

The invention will be better understood and other advantages thereof will appear more clearly in light of the following description, provided solely as a non-limiting example and done in reference to the appended drawings, in which.

DESCRIPTION OF THE PREFERRED EMBODIMENTS

Figure 30:
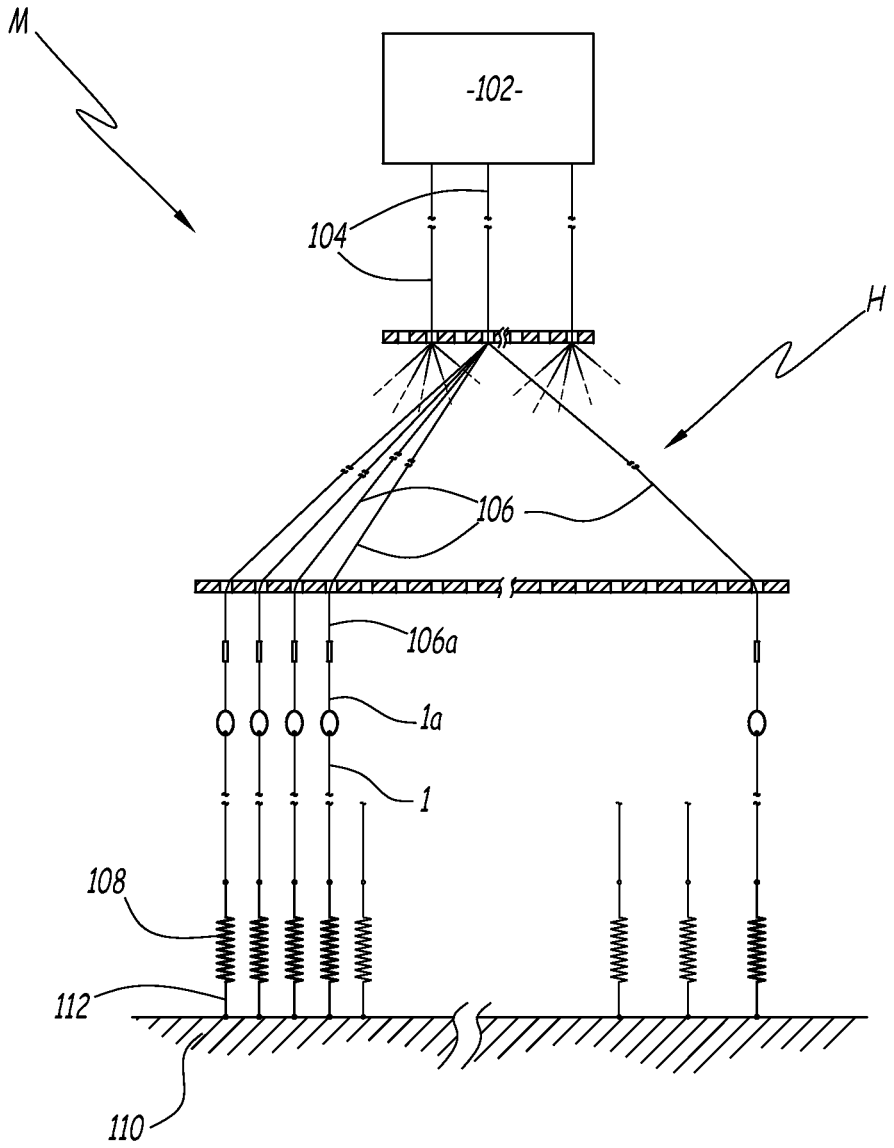
FIG. 30 is a diagrammatic illustration of a loom of the Jacquard type, according to the invention and incorporating one of the heddles shown in FIGS. 1 to 29.

The Jacquard-type loom M shown in FIG. 30 is equipped with a Jacquard mechanism 102 that commands several hooks 104, a lower end of which is associated with several arches 106. A lower end 106*a* of each arch 106 is connected to an upper end 1*a* of a guide heddle 1 of a warp yarn, each heddle 1 being subject to the action of a return spring 108 fastened to a fastening beam 110 by a rod 112, the beam 110 being fastened on a frame of the loom M. The elements 106, 1, 108, 110 and 112 form a harness H of the loom M.

FIGS. 1 to 11 show a first embodiment of a guide heddle 1 of a warp yarn of the loom M.

The guide heddle 1 extends lengthwise along a longitudinal axis X1 and comprises a heddle body 10 and an eye 2. The heddle body 10 includes two separate strands 4. References Y1 and Z1 denote two axes of the heddle 1, perpendicular to the axis X1, the axis Y1 corresponding to the width of the eye 2, while the transverse axis Z1 corresponds to its thickness.

At each end, the heddle body 10 has connecting means 11A or 11B for connecting to a spring 108 or an arch 106. At a first end of the heddle body 10, the connecting means 11A comprise an outer thread 12 that is designed to be screwed in a spring 108. At a second end of the heddle body 10, the connecting means 11B are designed to connect to an arch 106 of the Jacquard harness H. The means 11B comprise an end-piece 14 that forms an opening 16 for passage and jamming of the arch 106 and a rigid connecting tube 18, made from plastic or metal, which is mounted around the strand 4 with the possibility of movement along the axis X1 relative to the opening 16. The connecting means 11B are according to EP-B-1,741,815. Alternatively, other connecting means can be provided at the ends of the heddle body 10.

Figure 1:
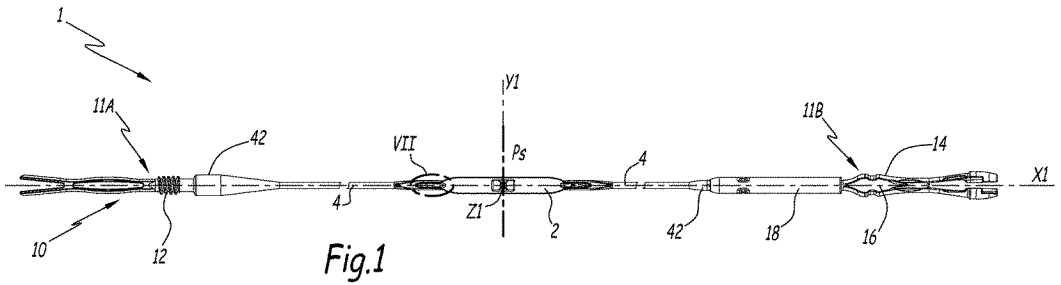
FIG. 1 is an elevation view of a guide heddle for a warp yarn for a loom of the Jacquard type according to a first embodiment of the invention.
Figure 2:
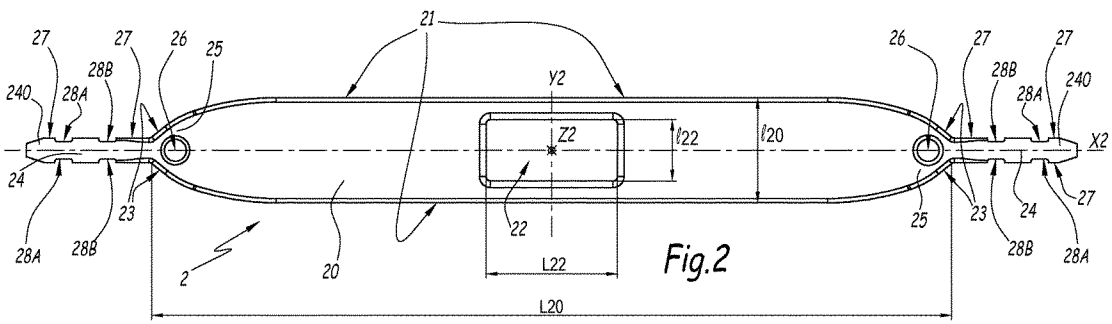
FIG. 2 is an enlarged view of an eye of the heddle of FIG. 1.
Figure 8:
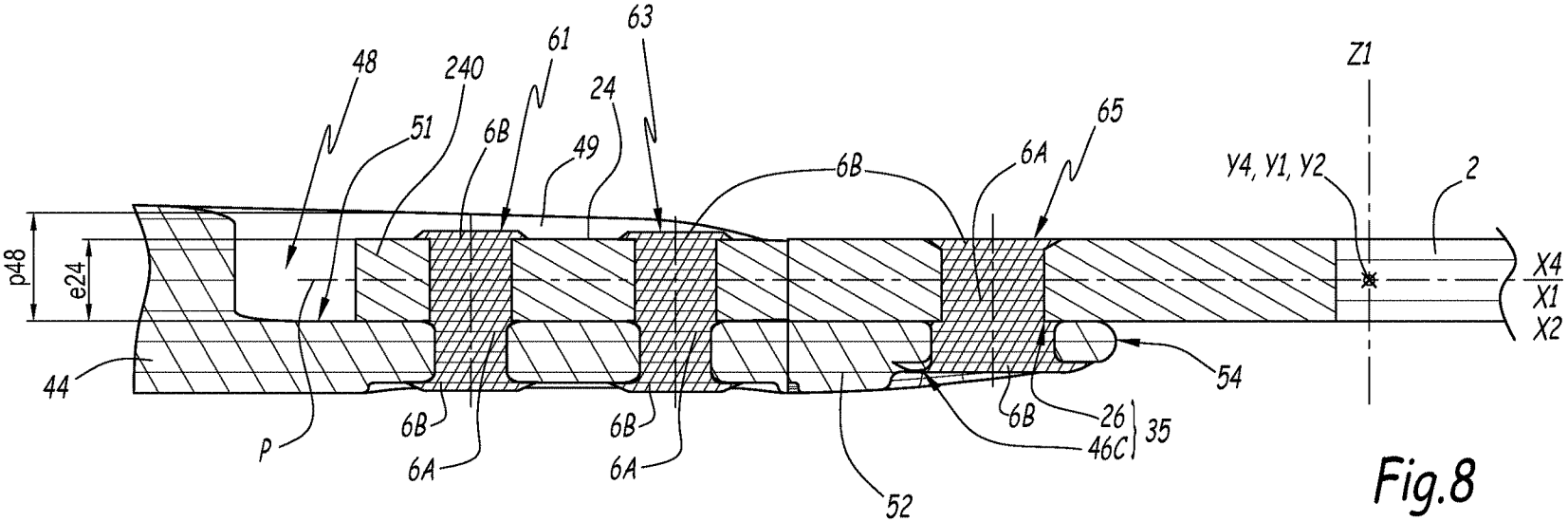
FIG. 8 is an enlarged partial sectional view, along plane VIII-VIII of FIG. 7, of an assembly zone between a strand and the eye.

The eye 2 is planar and extends lengthwise along a longitudinal axis X2. Reference Y2 denote a lateral axis, perpendicular to the axis X2. The eye 2 includes a central portion 20 that has lateral rims 21 rounded by polishing. The central portion 20 is provided with an orifice that forms an eyelet 22 for the passage of a warp yarn, said eyelet 22 crossing all the way through the eye 2 along a transverse axis Z2, perpendicular to the axes X2 and Y2. The axes X2, Y2 and Z2 are concurrent at the center of the eyelet 22. The eyelet 22 is rectangular in a main plane P of the eye 2 that contains the axes X2 and Y2. FIGS. 1 and 2 are parallel to that main plane P, which is shown in FIG. 8.

In the assembled configuration of the heddle 1, the axes X2, Y2 and Z2 are respectively combined with the axes X1, Y1 and Z1 of the heddle 1.

The eye 2 is symmetrical relative to a plane of symmetry $P_S$ that contains the axes Y2 and Z2.

Reference L22 denotes the length of the eyelet 22 measured parallel to the longitudinal axis X2 and L20 denotes the length of the central portion 20 of the eye 2 measured parallel to the axis X2. This length L20 is greater than or equal to five times the length L22. Reference l22 denotes the width of the eyelet 22 measured parallel to the lateral axis Y2. Lastly, l20 denotes the width of the central portion 20 of the eye 2 measured parallel to the axis Y2. The width l22 of the eyelet 22 is greater than half of the width l20 of the central portion 20 of the eye 2 and is preferably equal to 60% of the width l20.

The central portion 20 of the eye 2 is extended on each side along the longitudinal axis X2 by a tab 24. The tabs 24 have, along the axis Y2, a width l24 that is reduced relative to the central portion 20. Each tab 24 has a free longitudinal end 240 opposite the central part 20. The reduction in width along the axis Y2 is gradual, from the central portion 20 toward each tab 24.

The central portion 20 has, near each tab 24, two rounded cams 23 that provide the junction between the part with width l20 of the central portion 20 and the adjacent tab 24. Reference 25 denotes a transition defined in the central portion 20 near a tab 24 and bordered by cams 23.

The eye 2 includes a housing 26 at each transition zone 25. The housings 26 are formed by holes crossing all the way through the eye 2 parallel to the axis Z2 and have a circular section in the main plane P. Alternatively, the housings or holes 26 have an oblong or polygonal section in the main plane P. The housings 26 are designed to receive resin.

Reference 27 denotes the longitudinal edges of a tab 24. Each edge 27 is provided with two notches 28A and 28B offset along the axis X2 and that form housings for receiving resin, as shown by the following explanations.

The notches 28A and 28B extend over the entire thickness of the tabs 24 in the direction of the axis Z2 and are in the form of rectangular indentations in the main plane P. According to one alternative, the notches 28A and 28B of the eye 2 are in the form of semicircular indentations in the main plane P. On each side of the eye 2, the housing 26 and the notches 28A and 28B are offset, along the longitudinal axis X2, relative to one another.

The eye 2 is made from single-thickness metal. The eye 2 is made by cutting a treated steel sheet and its rims 21 are polished, so as to have rounded shapes not aggressive for the yarns. Alternatively, the eye 2 is made from polyamide or ceramic, metal and ceramic materials being favored for their hardness.

Reference e24 denotes the thickness of the tabs 24, measured parallel to the axis Z2.

References X4, Y4 and Z4 respectively denote a longitudinal axis and two transverse axes of a strand 4. In the assembled configuration of the heddle 1, the axes X4, Y4 and Z4 are respectively combined with the axis X1, Y1 and Z1 of the heddle 1.

Each strand 4 comprises a rod 41 having a round section along a transverse plane $P_T$ perpendicular to the longitudinal axis X4 and parallel to the axes Y4 and Z4. The rod 41 extends lengthwise between a first longitudinal end 42, on which the connecting means 11A or 11B are arranged, and a second longitudinal end 44 at which the assembly is done with the eye 2. At the end 44, each strand 4 widens along the lateral axis Y4 and fins along the transverse axis Z4, moving away from the rod 41. In other words, each end 44 has a cross-section that flattens moving away from the rod 41.

At its flat end 44, each strand 4 has a single receiving cavity 48 that receives a tab 24 of the eye 2. The receiving cavity 48 emerges in the direction of the longitudinal axis X4 and in the direction of the transverse axis Z4. The receiving cavity 48 is laterally delimited in the direction of the axis Y4 by two side walls 49. The receiving cavity 48 includes a bottom 51 that delimits it along the transverse axis Z4. Reference 61 denotes the width of the bottom 51 measured parallel to the lateral axis Y4. The bottom 51 has gradual variations in width l51 along the axis X4.

The bottom 51 of the cavity 48 is extended, in the direction of the longitudinal axis X4 toward the eye 2, by a final portion 52 that protrudes laterally from the side walls 49. The final portion 52 has a free end 54. The final portion 52 things toward the free end 54 widthwise along the lateral axis Y4 and also in terms of the thickness along the transverse axis Z4. In particular, the final portion 52 includes two edges 52A and 52B that converge toward the axis X4 as they come closer to the free end 54. Along the axis Z4, the final portion 52 is at the same level as the bottom 51.

The side walls 49 each extend by a beveled edge 50 toward the final portion 52, the beveled edges 50 producing the transition between the side walls 49 and the final portion 52. Each side wall 49 includes an inner surface 490 that has a rough and/or striated surface obtained directly during manufacturing of the strand 4.

Reference p48 denotes the depth of the receiving cavity 48 measured parallel to the transverse axis Z4 at the side walls 49. The depth p48 varies along the axis X4. In the assembled configuration of the heddle 1, at a same longitudinal level along the axis X1, the depth p48 is greater than the thickness e24, such that, when the tab 24 is received in the cavity 48 of the strand 4 with the tab 24 in contact with the bottom 51, the side walls 49 protrude past the tab 24 in a direction parallel to the axes Z2 and Z4. Each cavity 48 is globally complementary to the tab 24 that it receives.

According to an alternative that is not shown, the depth p48 is equal to the thickness e24.

Figures 3, 4:
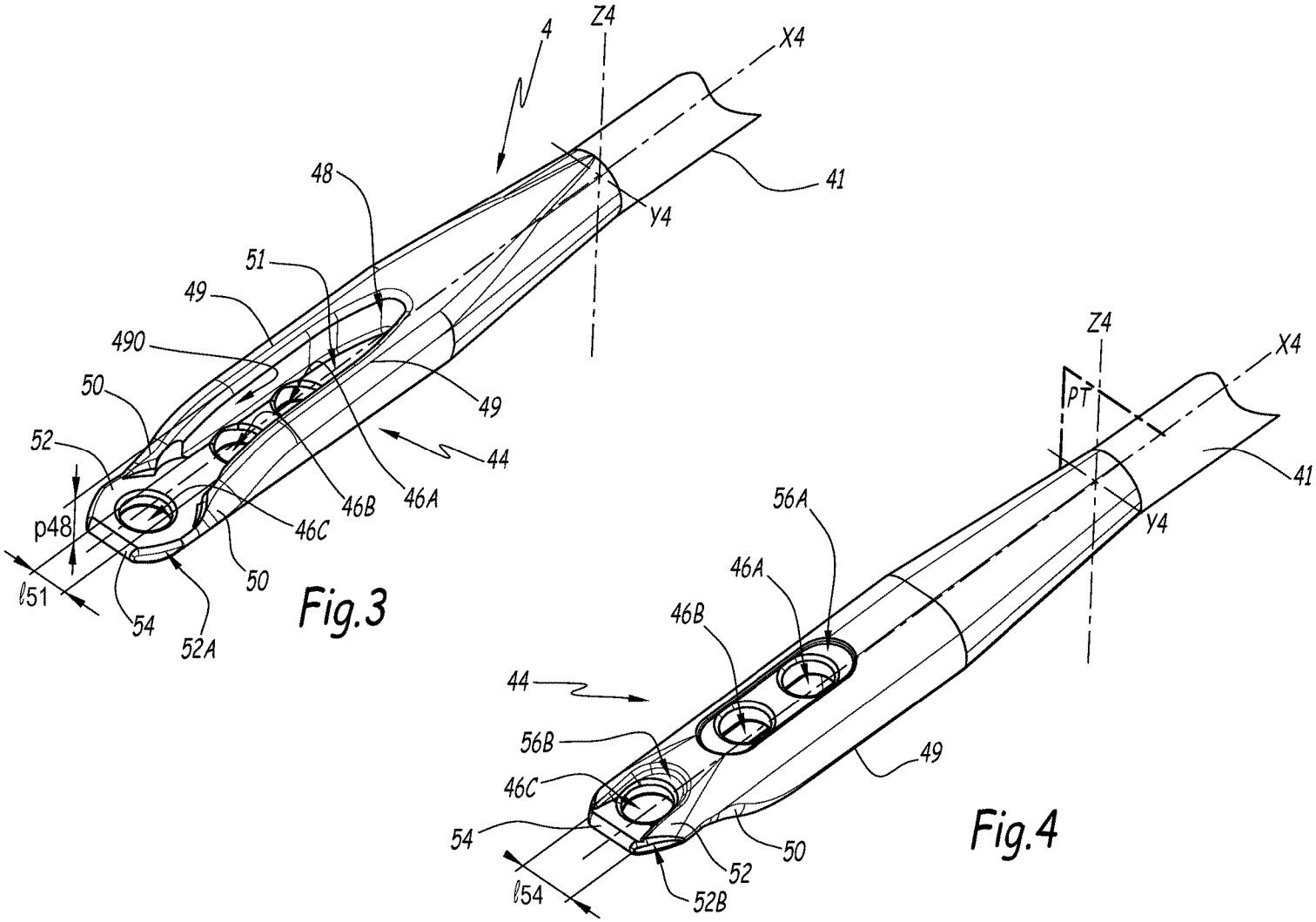
FIG. 3 is an enlarged perspective view of one end of a strand of the heddle of FIG. 1, a cavity being upwardly open in that figure.
FIG. 4 is a perspective view from another angle of the end of FIG. 3, the cavity facing downward in figure.
Figure 5:
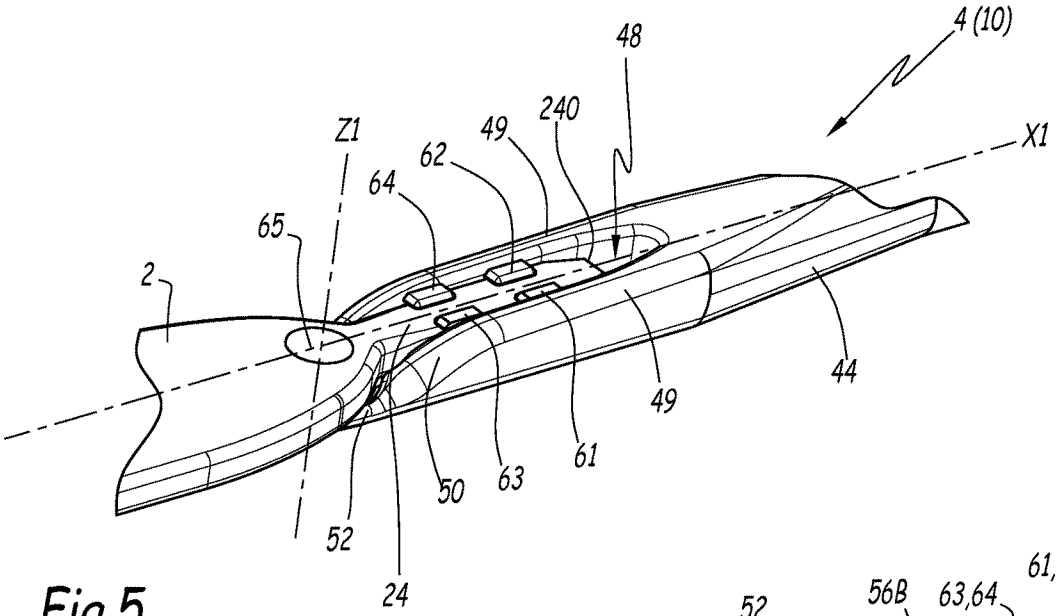
FIG. 5 is an enlarged partial perspective view of an assembly zone between a strand and the eye of the heddle in FIG. 1.
Figure 6:
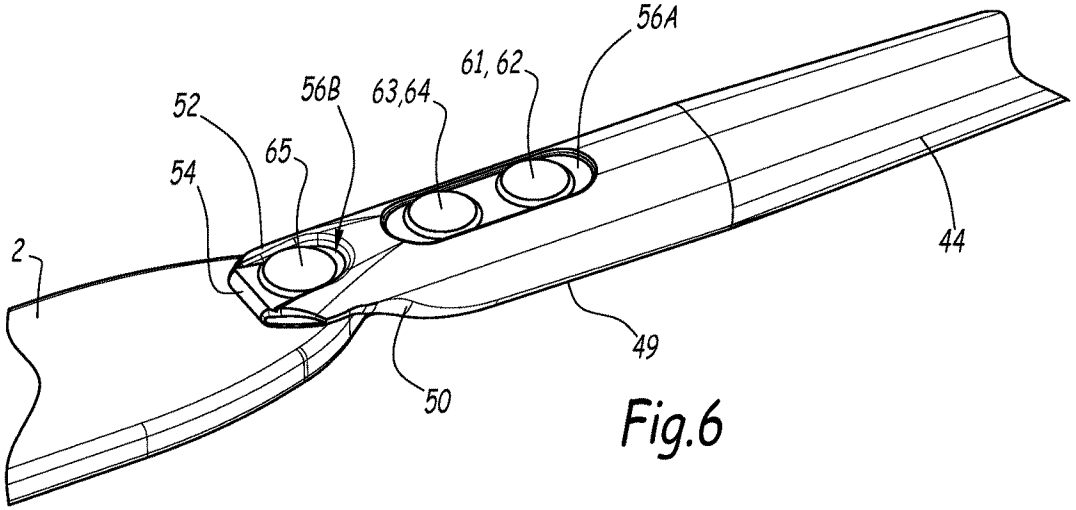
FIG. 6 is a view similar FIG. 5, from another angle.
Figure 7:
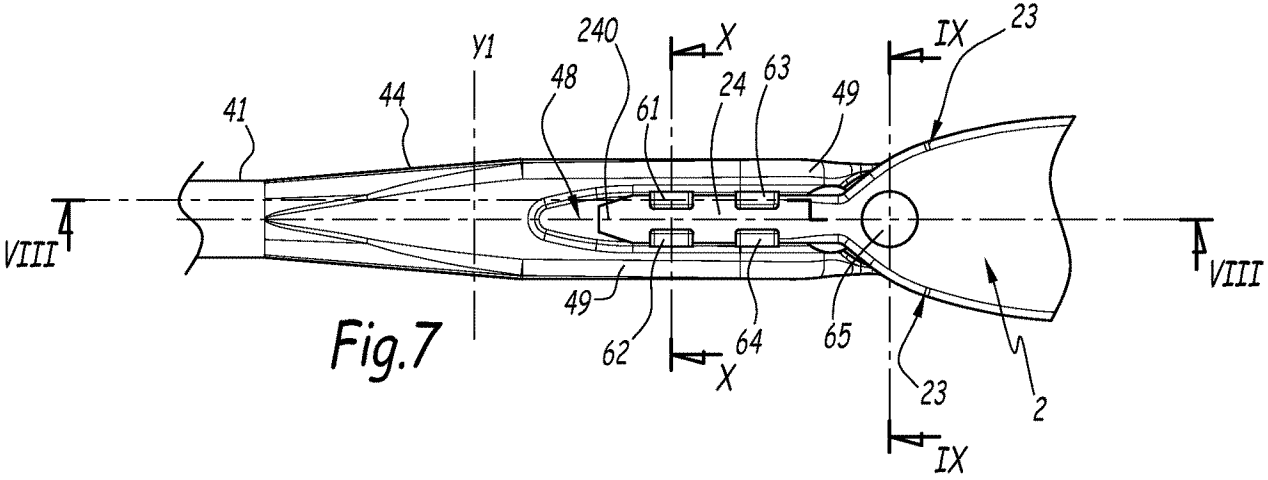
FIG. 7 is an enlarged view of detail VII in FIG. 1.

On the side of the end 44 opposite the receiving cavity 48, and as shown in FIG. 4, two longitudinal slots 56A and 56B are arranged.

Also arranged on the end 44 are three housings 46A, 46B and 46C, which are formed by holes crossing all the way through the end 44 parallel to the transverse axis Z4. The two housings 46A and 46B cross through the bottom 51 of the receiving cavity 48, while the housing 46C crosses through the final portion 52 of the strand 4. The three housings 46A, 46B and 46C are offset along the longitudinal axis X4. On the side of the end 44 opposite the receiving cavity 48, the two housings 46A and 46B emerge in the longitudinal slot 56A and the housing 46C emerges in the longitudinal slot 56B.

Each housing 46A, 46B and 46C has a circular section.

Alternatively, the housings 46A, 46B and 46C are holes having an oblong or polygonal section.

The strand 4 is made from polyamide and is manufactured by injection. Advantageously, the strand 4 is reinforced with fibers, for example glass or carbon fibers. The outer thread 12 and end-piece 14 of the connecting means 11A and 11B form a single piece with the rods 41.

In the mounted configuration of the heddle, i.e., when the eye 2 is assembled to each strand 4 by engagement of the tabs 24 in the cavities 48, the rounded cams 23 of the eye 2 are positioned longitudinally overlapping the final portion 52, such that, at the transition between the eye 2 and each strand 4, the central portion 20 of the eye 2 and the strand 4 overlap one another. The transition between the eye 2 and each strand 4 does not occur abruptly at the longitudinal ends 240 and 44 of the second parts but, on the contrary, takes place when the eye 2 and the strand 4 are overlapping.

Reference l54 denotes the width of the free end 54 of the final portion 52 measured parallel to the lateral axis Y4. Additionally, reference l23 denotes the width of the eye 2 between the rounded cams 23, that width l23 being measured parallel to the axis Y2 and along the axis X2 at the same longitudinal level as the free end 54 when the heddle is assembled. The width l54 is smaller than the width l23. This geometry limits the risks of catching of these yarns rubbing against the heddle 1.

The eye 2 and each strand 4 respectively overlap in the longitudinal direction X1, such that the housings 46A and 46B are respectively across from the notches 28A and 28B along the axis Z1 and such that the housing 46C is across from the housing 26 along the axis Z1. The housings 26, 28A and 28B of the eye 2 and housings 46A, 46B and 46C of the strand 4 then form five pairs of housings.

Figure 11:
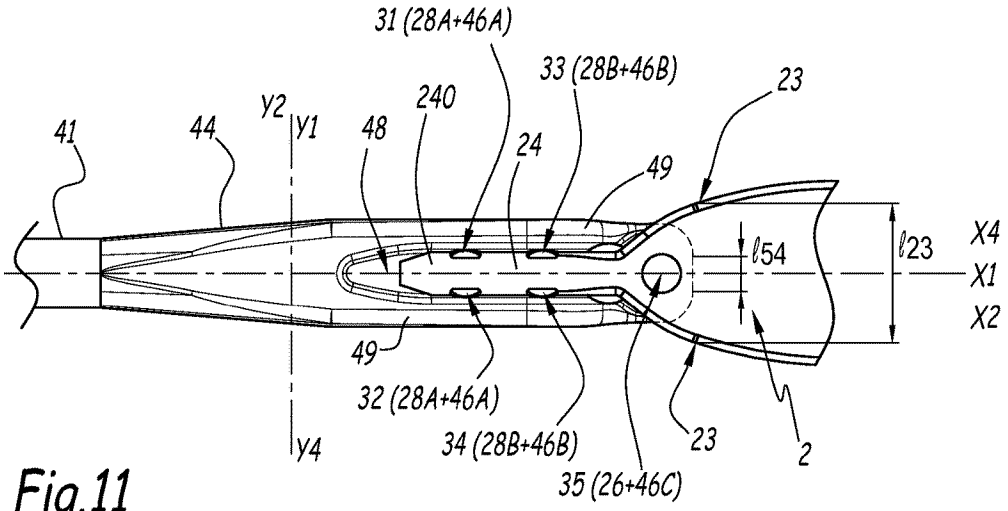
FIG. 11 is a view similar to FIG. 7 before the resin is deposited at the interface between the eye and the strand.

At each tab 24, these five pairs of housings are identified with references 31, 32, 33, 34 and 35 in FIG. 11. The pair of housings 31 is formed by the housing 46A and the notch 28A situated above the axis X1 in that figure, and which is closest to the free end 240. The pair of housings 32 is formed by the housing 46A and by the notch 28A situated below the axis X1 in that figure and which is closer to the free end 240. The pairs 33 and 34 are respectively formed by the housing 46B and the notches 28B respectively positioned above and below the axis X1 and that are furthest from the free end 240. The pair of housings 35 is formed by the housings 46C and 26.

During the manufacture of the heddle 1, two strands 4 are placed on a horizontal planar bearing surface, the cavities 48 being open on top, i.e., emerging on the same side along the axis Z1. The strand 4, which is designed to be connected to an arch, is provided with a connecting tube 18 prior to the assembly with the eye 2. The eye 2 is next placed on the two strands 4, with its tabs 24 engaged in each of the cavities 48, in contact with the bottoms 51 of the cavities 48.

The housings 26, 28A, 28B of the eye are positioned such that they are across in pairs from the housings 46A, 46B, 46C of the heddle body. In this configuration of the eye positioned on the two strands of the heddle body, the housings 26, 28A, 28B communicate with the housings 46A, 46B, 46C and emerge on a same side of the heddle along the axis Z1, which makes it possible to deposit the volumes of resin that will make up the set of the assembly members on a same side of the heddle at which the receiving cavities 48 of the strand emerge.

A controlled quantity of epoxide resin is then deposited in each pair of housings 31 to 35. Alternatively, the resin is an acrylic resin. This resin is deposited in each pair of housings when it is still liquid and spreads under the effect of gravity such that it fills each pair of housings. The excess resin is distributed in the slots 56A and 56B and in the receiving cavity 48. Lastly, the resin is hardened by heating under a temperature that depends on its composition. Alternatively, the resin hardens at ambient temperature or under ultraviolet or LED radiation. The resin solidifies in the pairs of housings. The solidified resin then forms assembly members 61, 62, 63, 64 and 65 in the form of rivets that each extend from the eye toward the heddle body along the axis Z1.

The resin is therefore deposited from each housing 26, 28A, 28B of the eye 2 and spreads under the effect of gravity and by capillarity until it reaches the housings 46A, 46B, 46C of the heddle body and in the slots 56A and 56B. The cavities 48 and the tabs 24 of the eye 2 remain visible during the resin placement and hardening operation.

For i comprised between 1 and 5, each assembly member or rivet 6*i* has no clearance in a pair of housings 3*i*. Each rivet 6*i* is a single piece and includes a body 6A that is situated at the pair of housings 3*i*, more specifically, that extends through the eye 2 and through the heddle body 10 along the axis Z1 from the housing of the eye of the pair of housings 3*i* to the inside of the housing of the heddle body of the pair of housings 3*i*. The body 6A extends globally in direction Z1, as shown in FIGS. 8 and 11. Each rivet 6*i* also includes a head 6B, on each side of the body 6A, on either side of the pair of housings 3*i*. Each head 6B forms a terminal part of the rivet 6*i* wider than the adjacent part of the body 6A of the rivet 6*i*. The heads 6B are formed by excess resin that overflows on the end 44 in the slots 56A and 56B and on the tab 24 received in the receiving cavity 48. As shown in FIGS. 5 to 8, the heads 6B of the side of the slots 56A and 56B are disk-shaped. On the opposite side, shown in FIG. 5, the head 6B of the rivet 65 is also disk-shaped, while the heads 6B of the rivets 61 to 64 are in the form of rectangular studs with rounded rims.

Figure 10:
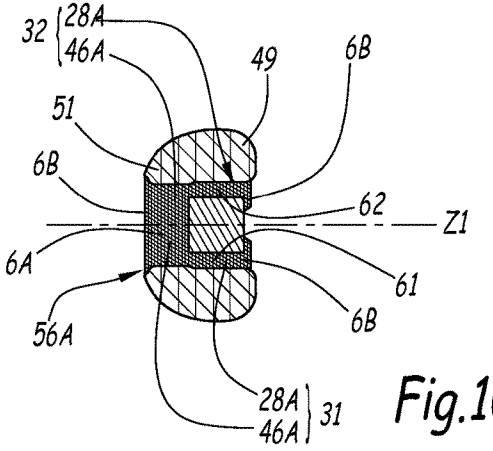
FIG. 10 is an enlarged sectional view along plane X-X in FIG. 7.
Figure 9:
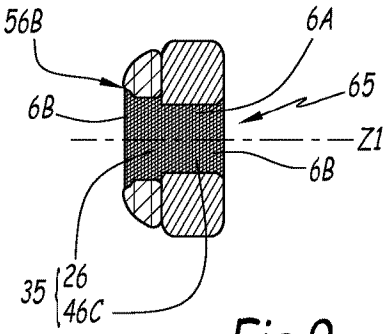
FIG. 9 is an enlarged sectional view along plane IX-IX in FIG. 7.

As more particularly shown in FIG. 10 and inasmuch as the housing 46A is shared by the pairs of housings 31 and 32, the rivets 61 and 62 are connected. In other words, the body 6A of the rivet 61 received in the housing 46A forms a single piece with the body 6A of the rivet 62 received in the housing 46A and the heads 6B of the two rivets 61, 62 positioned in the slot 56A form a single piece. The same is true for the housing 46B, the pairs 33 and 34 and the rivets 63 and 64.

These rivets 6*i* provide a connection between the final end 44 of each strand 4 and the corresponding tab 24 of the eye 2. The assembly rivets 6*i* act as obstacles positioned between the strand 4 and the eye 2. Indeed, each rivet or obstacle 6*i* is engaged in the eye 2 and in the strand 4 in both directions of the axis X1, such that it is necessary for the resin bodies 6A to break to allow a relative movement between the eye 2 and the strand 4 along the longitudinal axis X1. As long as they are not broken, the rivets 6*i* secure the eye 2 and the strand 4. In order to transmit the connecting forces along the axis X1, a section of each body 6A is biased in shear. The connecting forces are therefore not transmitted by adherence at the interfaces of the resin with the body or eye. The heads 6B of the rivets 6*i* prevent the eye 2 and the strand 4 from separating in the transverse direction Z1. The volume of resin between the notches 28A, 28B and the edges 49 as well as the rivet 65 secure the eye 2 and the strand 4 along the lateral axis Y1. The rivets 6*i* also provide a connection of the eye 2 with strand 4 around the axes X1, Y1 and Z1.

The advantage of using rivets 6*i* placed in the housings in liquid form and which solidify in the housings is that the resin fills and assumes the shape of the housings to form an obstacle, without clearance with the eye or the heddle body, to the relative movement of the eye and the body along at least the axis X1. Using the resin also makes it possible to optimize the geometries of the housings of the pair of housings, which can have different geometries and different sections. The rivets 6*i* do not bias the eye 2 or the strands 4 when they are placed and during hardening of the resin, unlike attached solid rivets in the parts to be assembled. Furthermore, when the resin is deposited, it may extend between several pairs of housings, parallel to the longitudinal axis X1 and lateral axis Y1. The resin then forms bridges that connect the heads 6B of some of the rivets 6*i* to one another. In other words, a head 6B of a rivet 6*i* positioned in a first pair of housings forms a single piece with the head 6B of at least one other rivet 6*i* positioned in a second pair of housings. These first and second pairs of housings are distributed in the longitudinal direction and/or distributed in the lateral direction. In that case, the mechanical blocking force of the heddle body and the eye is improved.

In that respect, the slots 56A and 56B can, alternatively, be communicating to allow the creation of a bridge between the rivets 61, 62, 63, 64 on the one hand, and 65 on the other hand.

The rivet bodies 6A, the rivet heads 6B and any bridges, remain contained in the inner volume of the receiving cavity 48 and in the volume of the slots 56A and 56B on the opposite side. The cavity 48 and the slots 56A and 56B then protect the adjacent yarns from rubbing with the rivets 6*i*.

Since the housings receiving the resin cross through the eye 2 and the strands 4 in the direction of the transverse axis Z1, it is possible to inspect the proper placement of the eye 2 relative to each strand 4 and also the proper placement of the resin in the pairs of housings 3*i* for the formation of homogenous rivets 6*i* with controlled sections.

According to an alternative that is not shown in the figures, the receiving cavity 48 is arranged in the eye 2 and the end 44 of the strand 4 has a reduced width received in that cavity 48. The strand 4 and the eye 2 overlap in the longitudinal direction and form the pairs of housings 3*i*.

Figure 12:
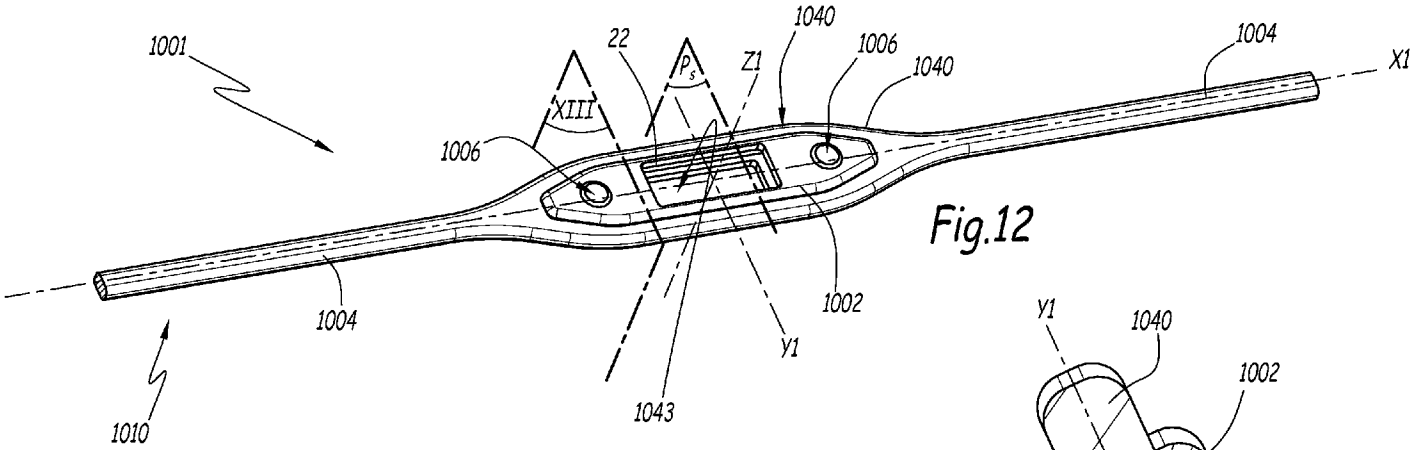
FIG. 12 is a partial perspective view of a guide heddle according to a second embodiment of the invention.
Figure 13:
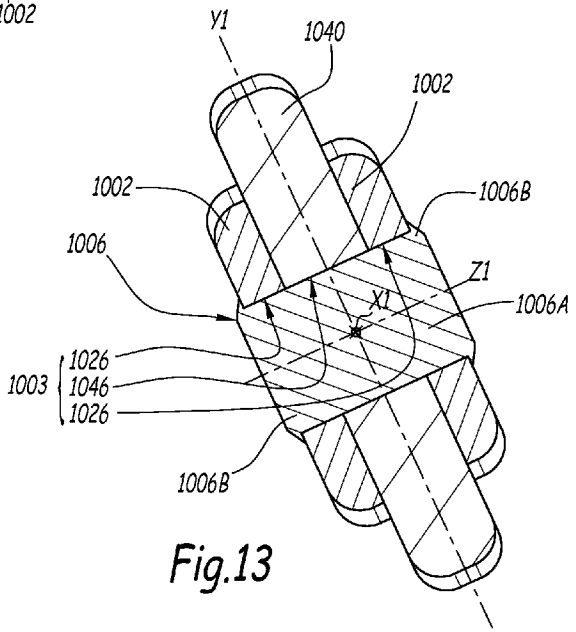
FIG. 13 is an enlarged sectional view, along plane XIII-XIII of FIG. 10.

FIGS. 12 and 13 show a second embodiment of a guide heddle 1001 for a warp yarn of a loom of the Jacquard type. The elements of the second embodiment bear the same references as those of the first embodiment increased by 1000. Hereinafter, we will not provide a detailed description of the elements of the second embodiment that are similar to those of the first embodiment.

In the second embodiment, the heddle 1001 comprises a single-piece heddle body 1010 provided with two strands 1004 that extend as far as ends comprising means (not shown) for connecting to an element of the harness of the loom. The single-piece body 1010 includes a wider central portion 1040 and two housings 1046 distributed, in the longitudinal direction X1, on either side of the opening 1043, and which cross all the way through that portion 1040 along the direction of the transverse axis Z1. The heddle 1001 also includes two metal eyes 1002 that longitudinally overlap the central portion 1040 on each side thereof along the axis Z1, in contact with the central portion 1040. Each eye 1002 includes two housings 1026 that cross all the way through it along the direction of the transverse axis Z1 and are positioned on either side of an eyelet 22 along the axis X1. Each of the two housings 1026 of the two eyes 1002 communicates with a housing 1046 of the strand 1004 and forms, with that housing 1046, a pair of housings 1003.

Alternatively, a single eye longitudinally overlaps the heddle body 1010.

During the manufacture of the heddle 1001, a quantity of liquid resin is deposited in each pair of housings 1003, and once hardened, forms assembly members 1006 in the form of rivets. Each assembly rivet 1006 includes two heads 1006B for maintaining the eyes 1002 against the strand 1004 in the direction of the transverse axis Z1. Each rivet 1006 also includes a rivet body 1006A that extends in the direction Z1 through the eyes 1002 and the heddle body 1010 and secures the eyes 1002 and the strand 1004 in the directions of the longitudinal X1 and lateral Y1 axes. The rivets 1006 connect the eyes 1002 with the body 1010 around the axes X1, Y1 and Z1.

Figure 14:
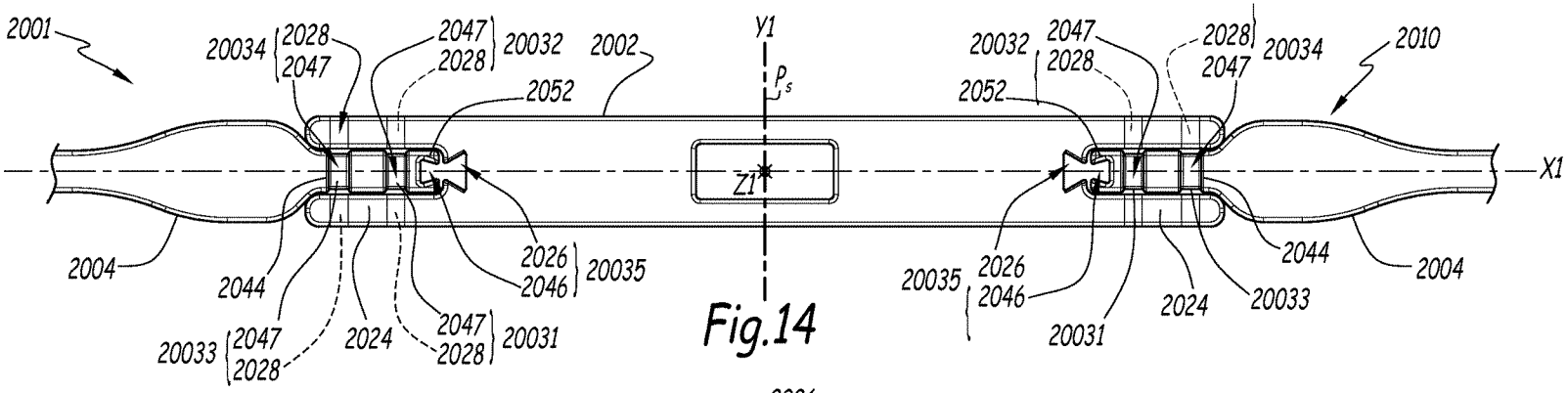
FIG. 14 is a partial elevation view of a guide heddle according to a third embodiment of the invention.
Figure 16:
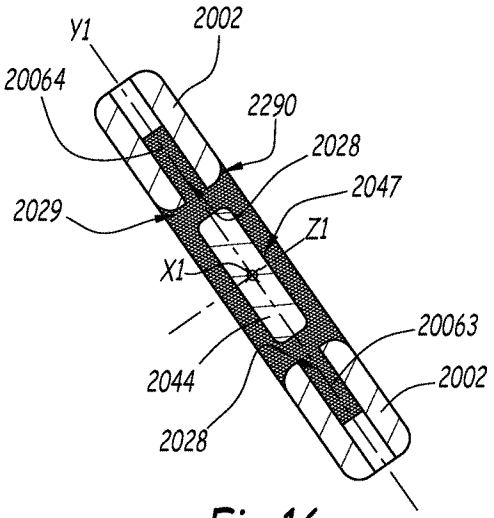
FIG. 16 is a sectional view, along plane XVI of FIG. 15.
Figure 15:
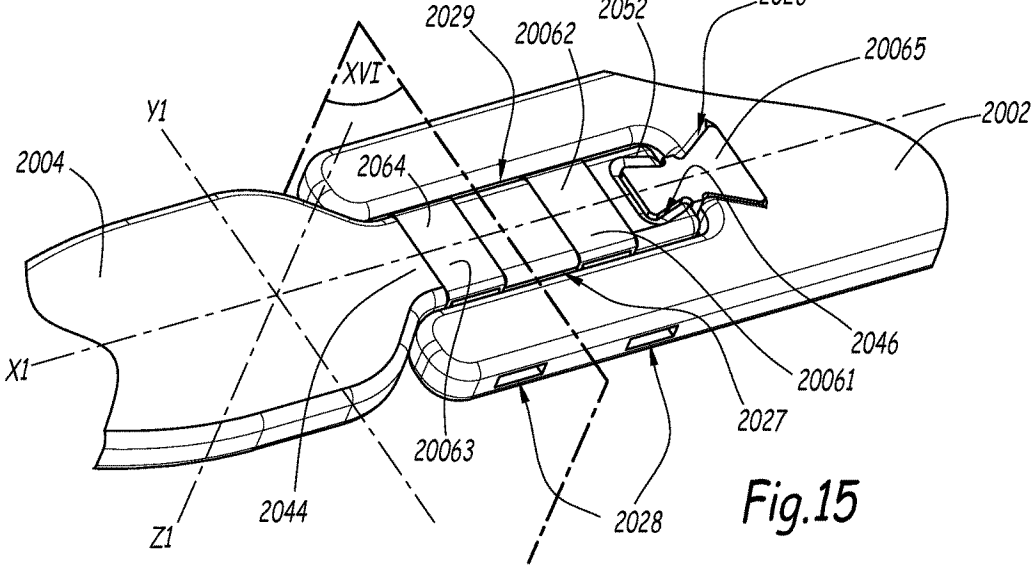
FIG. 15 is an enlarged perspective view of an assembly zone between a strand and the eye of the heddle in FIG. 14.
Figure 17:
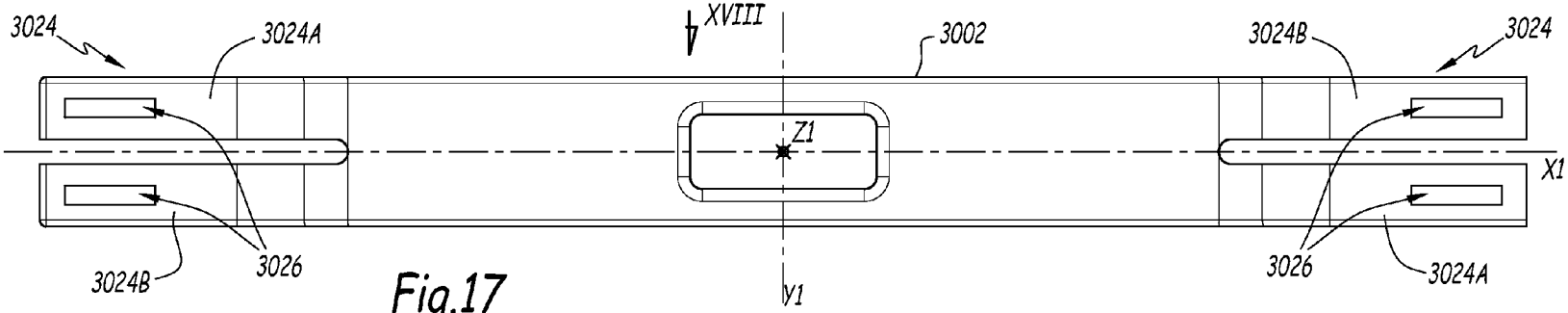
FIG. 17 is an elevation view of an eye belonging to a heddle according to a fourth embodiment of the invention.
Figure 18:
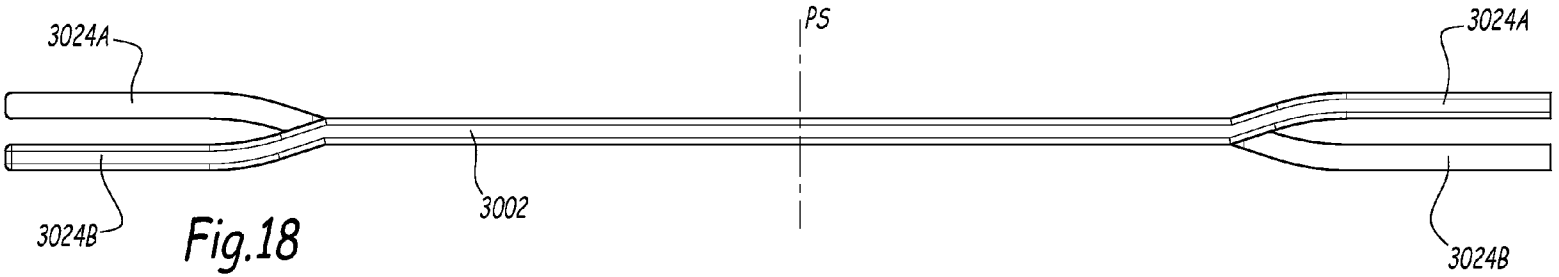
FIG. 18 is a side view along arrow XVII of the eye of FIG. 17.
Figure 19:
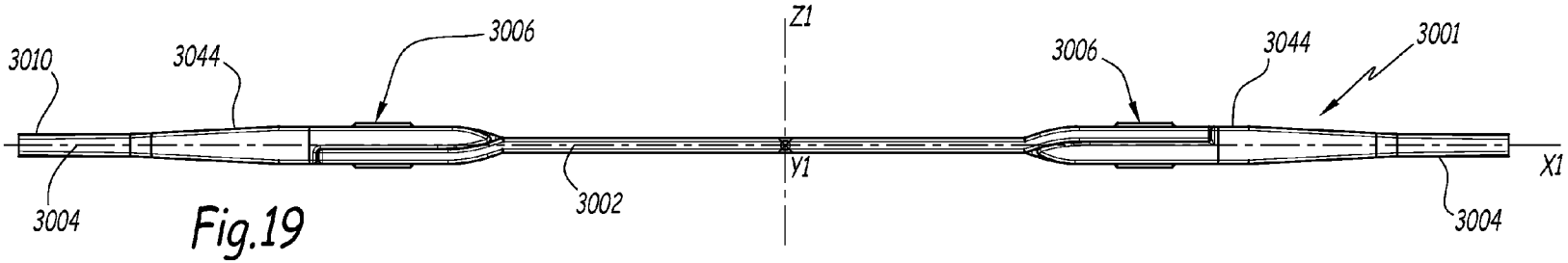
FIG. 19 is a view similar to FIG. 18, but on a smaller scale, when the eye is assembled to strands within the heddle according to the fourth embodiment.

FIGS. 14 to 16 show a third embodiment of a guide heddle 2001 for a warp yarn for a loom of the Jacquard type. The elements of the third embodiment bear the same references as those of the first embodiment, increased by 2000. Hereinafter, we will not provide a detailed description of the elements of the third embodiment that are similar to those of the first embodiment.

FIG. 14 shows the eye 2002 and the strands 2004 of the heddle 2001 in the preassembled position, before depositing the resin. The heddle 2001 comprises an eye 2002 and a heddle body 2010 including two strands 2004. The eye 2002 is symmetrical relative to a plane of symmetry $P_S$ defined as in the first embodiment and includes, at each end 2024, an opening 2029 that crosses all away through it in the direction of the transverse axis Z1, which emerges in the direction of the longitudinal axis X1 across from each strand 2004 and which delimits two branches at each end of the eye. The opening 2029 has an edge 2290 on which holes 2028 are arranged that cross all the way through each branch in the direction of the lateral axis Y1, as shown in FIG. 15. At the bottom of the opening 2029, at the edge 2290, the eye 2002 also includes a notch 2026 that is a through notch in the direction of the transverse axis Z1 and emerges in the opening 2029.

The end 2044 of each strand 2004 has two zones 2047 with a narrower width and thickness along the axes Y1 and Z1. The narrower zones 2047 form surface notches on the ends 2044, both along the lateral edges 2027 of those ends and on their main faces parallel to the axis Y1. Each end 2044 also has a notch 2046 arranged on the edge of its free end 2052 that crosses all away through it in the direction of the transverse axis Z1 and that emerges in the direction of the longitudinal axis X1 across from each housing 2026 of the eye 2002.

The end 2044 of each strand 2004 is received in one of the two openings 2029. Each zone 2047 of each strand 2004 is across, along the axis Y1, from two holes 2028 of the eye 2002 and forms, with those holes 2028, two pairs of housings 20031 and 20032, 20033 and 20034, respectively. The two notches 2047 and these four holes 2028 thus form the four pairs of housings 20031, 20032, 20033 and 20034. Furthermore, the notch 2046 is across, along the axis Z1, from the housing 2026, and together they form a pair of housings 20035.

For i comprised between 1 and 5, at each end 2024 of the eye 2, a quantity of liquid resin is deposited in each pair of housings 2003*i* and constitutes, once solidified, a rivet-forming member 2006*i* that extends along the axis Y1 through the eye and through the body. The rivets 20061 to 20064 perform the assembly of the elements 2002 and 2004 in the directions of the longitudinal X1 and transverse Z1 axes, as shown in FIG. 16. In particular, the resin extends around the strands 2004 in each zone 2047 with a reduced thickness as far as the holes 2028 of the eye 2002, as shown in FIG. 16. As shown in FIG. 16, the assembly rivets 20063 and 20064 form a single piece and are connected to one another on either side of the end 2044. In other words, the body 6B of the rivet 20063 forms a single piece with the body 6B of the rivet 20064. The same is true for the assembly rivets 20061 and 20062. The rivets 20061 to 20064 connect the eye 2 with the strand 2004 around the axis X1, the axis Y1 and the axis Z1.

The assembly rivet 20065 provided in the pair 20035 is configured to form a resin obstacle in the form of a double-divergent corner, acting to secure the eye 2002 and each strand 2004 along the longitudinal axis X1 and the lateral axis Y1 of the heddle 2001.

FIGS. 17 to 22 show a fourth embodiment of a guide heddle 3001 for a warp yarn for a loom of the Jacquard type. The elements of the fourth embodiment bear the same references as those of the first embodiment, increased by 3000. Hereinafter, we will not provide a detailed description of the elements of the fourth embodiment that are similar to those of the first embodiment.

The heddle 3001 comprises an eye 3002 and a heddle body 3010 including two strands 3004. The eye 3002 is asymmetrical relative to a plane $P_S$ defined as for the first embodiment. The eye 3002 has, at each end 3024, two branches 3024A and 3024B cambered in opposition. Each branch 3024A, 3024B includes a housing 3026 crossing all the way through the branch along the axis Z1. The end 3044 of each strand 3004 includes two cavities 3048 that are arranged on two opposite faces of the strand 3004 along the axis Z1, each cavity 3048 having a single lateral edge 3049 and therefore emerging toward the outside of the strand 3004 laterally along the axis Y1 and longitudinally along the axis X1. Each cavity 3048 includes a bottom 3051 along the axis Z1. At each cavity, a housing 3046 extends along the axis Z1 and has a rectangular section considered perpendicular to the axis Z1. The housings 3046 are blind; they emerge in the corresponding cavity and do not cross through the bottoms 3051 along the transverse axis Z1. In the assembled configuration of the heddle 3001, the branches 3024A and 3024B of the eye 3002 are placed around the ends 3044 of the strands 3004, in the cavities 3048.

Figure 22:
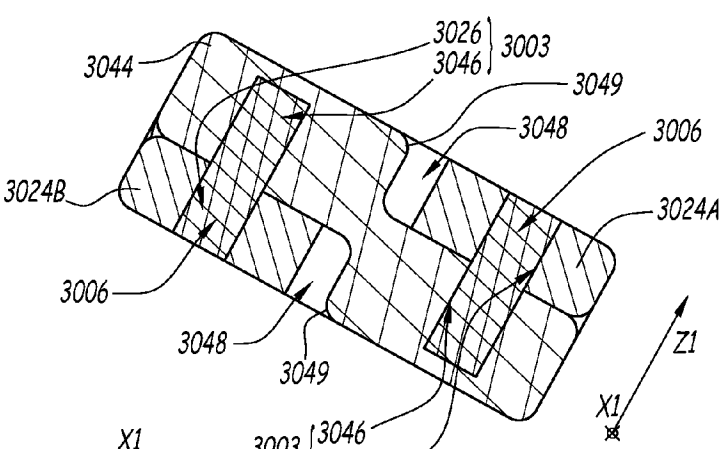
FIG. 22 is an enlarged sectional view, along plane XXII of FIG. 20.
Figure 21:
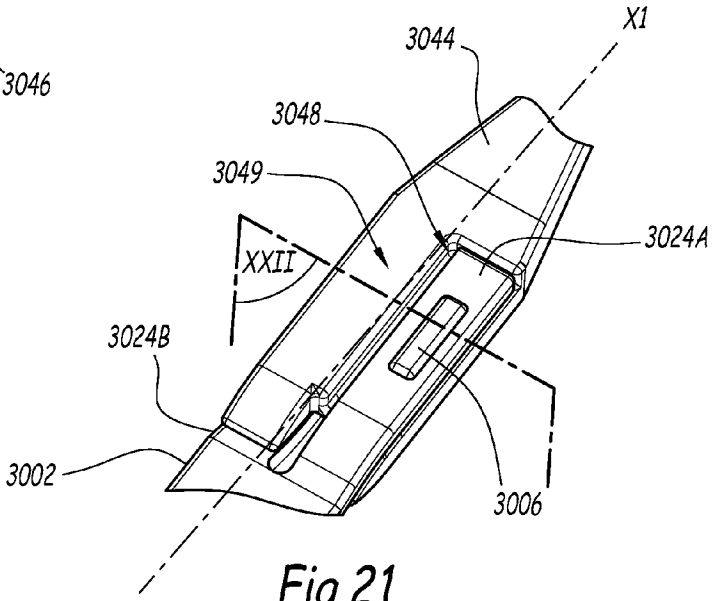
FIG. 21 is a view similar to FIG. 20, when the eye and the strand are assembled.
Figure 20:
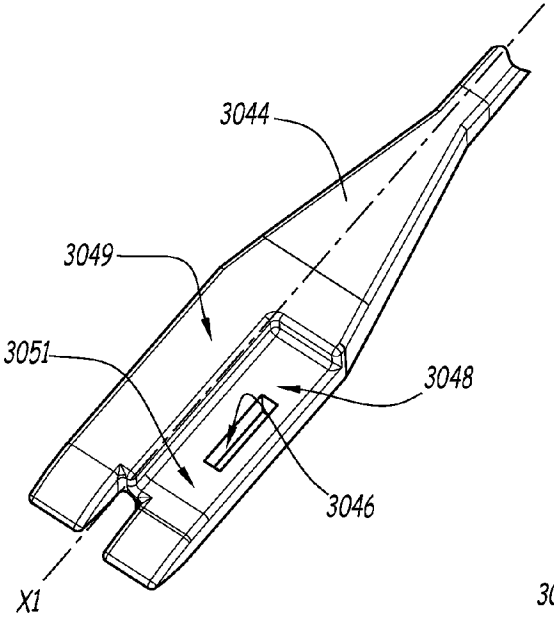
FIG. 20 is a partial enlarged perspective view of a strand of FIG. 19.
Figure 23:
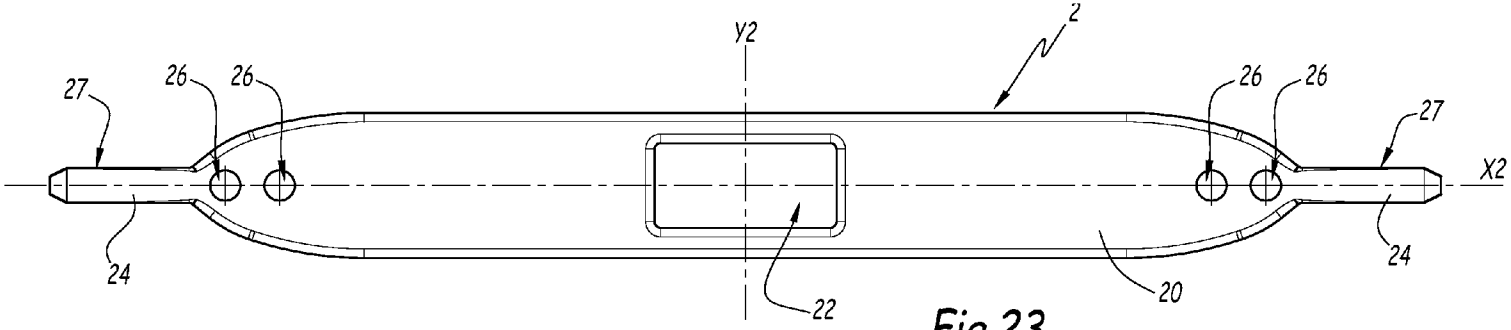
FIGS. 23 to 29 are views similar to FIGS. 2 to 8, respectively, some of which are on a smaller scale, for a guide heddle according to a fifth embodiment of the invention.
Figure 25:
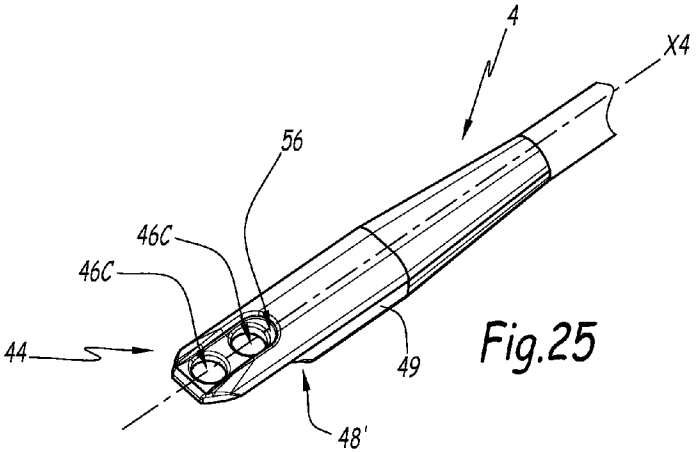

Thus, each housing 3046 of the strand 3004 is across, in the direction of the transverse axis Z1, from the corresponding through housing 3026, and together they form pairs of housings 3003. A quantity of resin is deposited in the four pairs of housings 3003 of the heddle 3001 and constitutes, once hardened, assembly members 3006 in the form of rivets. Each assembly rivet 3006 is made up of a body extending along the axis Z1, without a rivet head, as shown in FIG. 22, and secures the eye 3002 with each strand 3004 along the longitudinal axis X1 and along the lateral axis Y1, and around the axis X1, the axis Y1 and the axis Z1. The securing along the transverse axis Z1 is provided by mechanical blocking due to the cooperation of each strand 3004 and the cambered branches 3024A, 3024B on either side of the end 3044 of each strand 3004.

FIGS. 23 to 29 show a fifth embodiment of a guide heddle 1 for a warp yarn for a loom of the Jacquard type. Inasmuch as this embodiment is structurally close to the first embodiment mentioned above, the elements shared by these two embodiments bear the same references. Hereinafter, we will not provide a detailed description of the elements of this fifth embodiment that are similar to those of the first embodiment.

The eye 2 of this embodiment differs from that of the first embodiment in that the edges 27 of the tabs 24 with reduced width have no notch 28. In other words, these edges 27 are straight. Furthermore, the central portion 20 of the eyelet 22 is provided, in each transition zone 25 and near each tab 24, with two housings 26 that are aligned along the axis X2, which cross all the way through the central portion 20 and which have a circular section.

Furthermore, the second end 44 of each strand 4 comprises a cavity 48 that is defined between two side walls 49, a bottom 51 and a ceiling 53 opposite the bottom 51 and that connects the side walls 49. In other words, compared with the cavity 48 of the first embodiment, the cavity 48 of this embodiment does not emerge opposite the bottom 51, along a transverse axis Z4 defined as in the first embodiment.

Furthermore, a final portion 52 of the end 44 that extends the bottom 51 in the direction of the longitudinal axis X4 of the strand 4, i.e., in the direction of the longitudinal axis X1 of the heddle in the mounted configuration thereof, toward the eyelet 22 of the eye 2, is provided with two housings 46C that cross all the way through that final portion 52 and that also have a circular section.

In the assembled configuration of the heddle 1, the cavity 48 of each end 44 receives a tab 24 of the eye 2. In that configuration, the two housings 26 arranged at one end of the central portion 20 are respectively aligned with the two housings 46C arranged in the final portion 52 of the adjacent strand 4. Two pairs of housings 35 are thus formed each made of a housing 26 and a housing 46C.

Figure 24:
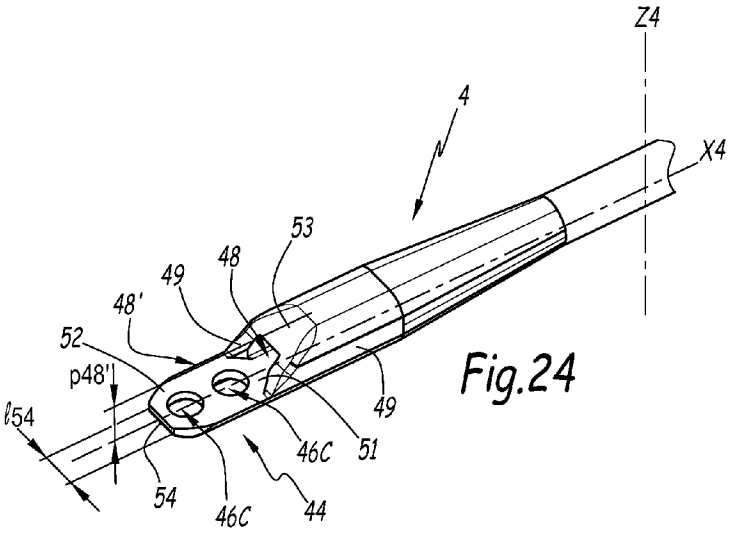
Figure 26:
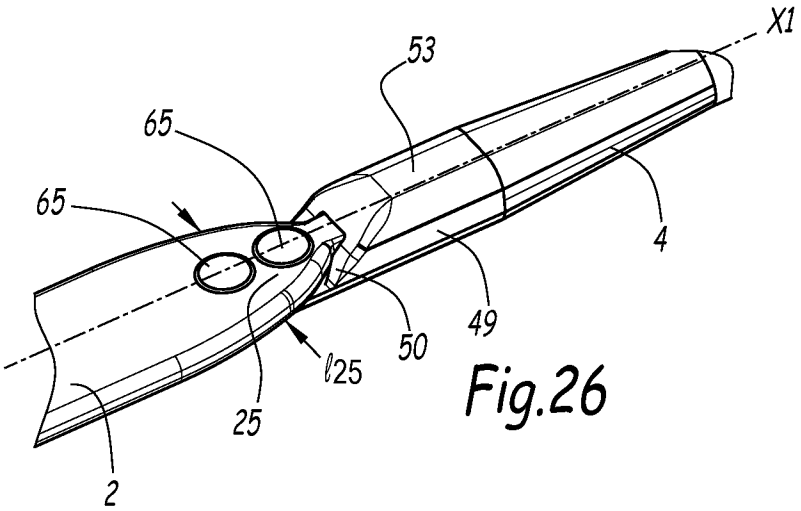
Figure 27:
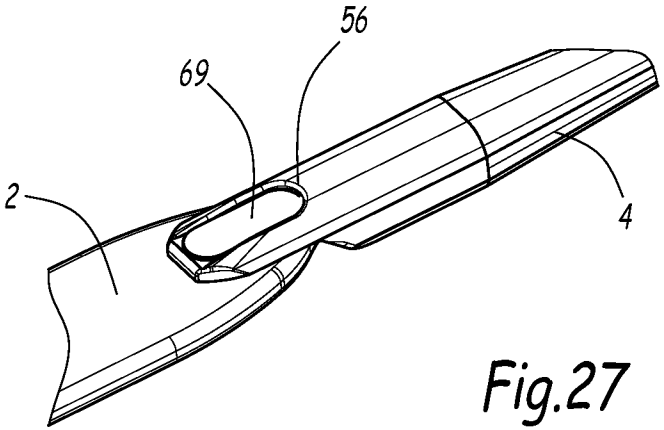
Figure 28:
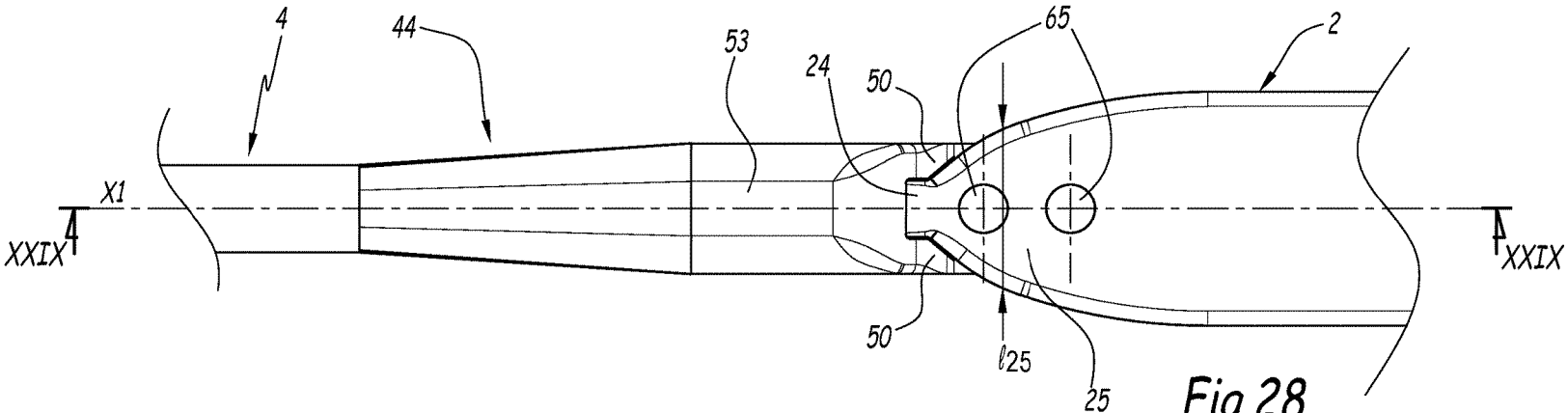

As shown more particularly by FIG. 24, the cavity 48 is arranged in a proximal part of the end 44, i.e., in a part of that end closer to the middle of the strand 4 than the final portion 52. Furthermore, a distal cavity 48' is arranged across from the final portion 52, on a single transverse side of the strand 4, the cavity being defined by the dihedron formed by the face of the final portion 52 visible in FIG. 24 by the beveled edges 50 of the walls 49 that join that face, on either side of the mouth of the cavity 48. The bottom of the distal cavity 48' in the direction Z1 is formed by the final portion 52. The cavity 48' has no side wall, i.e., it is not delimited by physical walls along the lateral axis Y1. This distal cavity 48' receives, in the mounted configuration of the heddle 1, the transition zone 25 of the central portion 20 of the eye 2 in which the housings 26 are arranged.

Reference p48' denotes the depth of the cavity 48' measured parallel to the transverse axis Z4 between the final portion 52 and the end of the beveled edges 50 furthest from the final portion 52. The depth p48' varies along the axis X1. Reference e25 denotes the thickness of the transition portion 25, measured parallel to the axis Z2. In the assembled configuration of the heddle 1, at a same longitudinal level along the axis X1, the depth p48' is greater than the thickness e25.

Reference l25 denotes the width of the transition portion 25 measured parallel to the lateral axis Y1 of the heddle 1. Reference l54 denotes the width of the free end 54 of the final portion 52 also measured parallel to the axis Y1. The width l54 is smaller than the width l25 at the same longitudinal level. Furthermore, the final portion 52 has a gradual reduction in width along the lateral axis Y1, toward the free end 54. The transition zone 25 of the eye 2 is positioned along the axis X1 overlapping the final portion 52 at the longitudinal level of the cavity 48'. This transition portion 25 has a gradual reduction in width along the lateral axis Y1, toward the free end 240 of the eye 2.

During manufacturing of this heddle 1, when the eye 2 provided with its two tabs is engaged with the two strands 4 each provided with its receiving cavity 48 and its distal cavity 48', the pairs of housings 35 are formed, it is possible to pour an assembly member of the resin rivet type 65 into each of them. After the resin has solidified, this rivet secures the parts 2 and 4 at their overlapping ends.

FIG. 2 shows that, on the side of the slot 56 that is arranged in the final portion 52 opposite the cavity 48, the heads of the rivets 65 are connected by a base plate 69 that substantially fills that entire slot 56.

Figure 29:
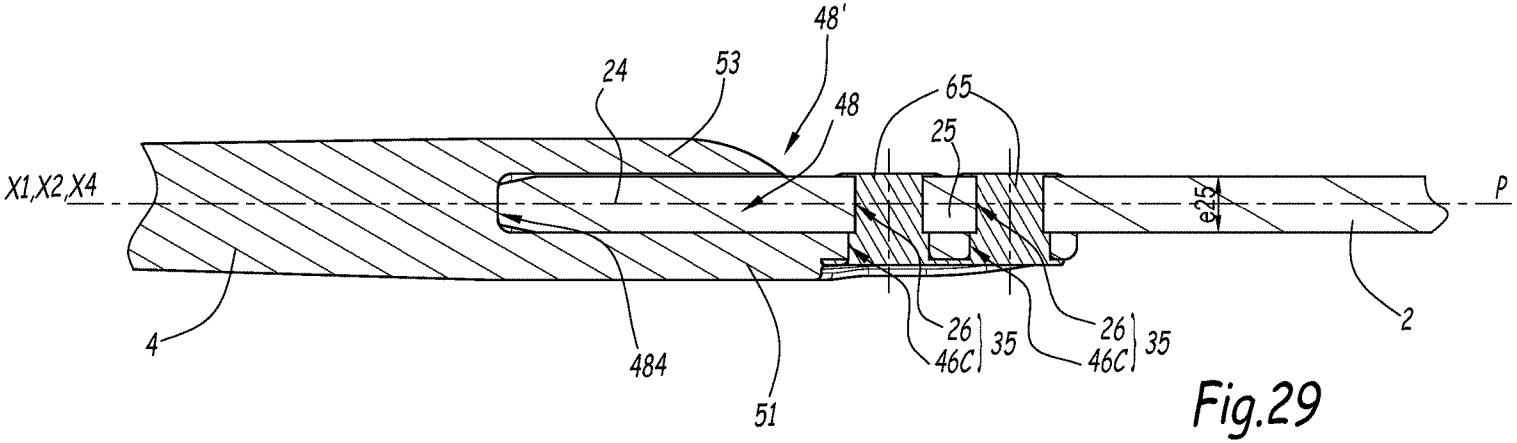

As shown more particularly in FIG. 29, the parts 2 and 4 overlap one another by the transition zone 25 and by the final portion 52. Thus, the overlap between the parts 2 and 4 takes place on a single transverse side of each of these parts. In particular, at the longitudinal level of the cavity 48', i.e., along the longitudinal axis X4, the part 2 overlaps the part 4 by a single transverse side of the part 2. Thus, in the zone where the rivets 65 are formed, it is possible to access each of those parts 2 and 4 by a transverse side.

According to one advantageous aspect of the invention that is not shown, the ceiling 53 can be pierced with an opening providing access to the inside of the cavity 48, near the closed end 484 of that cavity, i.e., its end opposite its mouth. This in particular makes it possible to view the tab 24 of the eye in place in the proximal cavity 48.

According to a first alternative of this fifth embodiment that is not shown, the cavity 48 is removed in each strand 4, as well as the tab 24 at each end of the central portion 20.

In that case, the overlap between the parts 2 and 4 takes place only at the final portion 52, by engaging the transition zone 25 of the end of the central portion 20 in the cavity 48', with an overlap of a single transverse side of each of the parts 2 and 4.

According to another alternative that is also not shown of this fifth embodiment, the pairs of housings comparable to the pairs of housings 31 to 34 of the first embodiment can extend to the closed cavity 48. In that case, housings with an appropriate shape are provided in the tabs 24 as well as in the bottom 51 and/or in the ceiling 53 and/or in the side walls 49. The housings of the tabs 24 can be notches, as in the first embodiment, or through housings with a circular section, like the housings 26 of the fifth embodiment.

Irrespective of the embodiment, the heddle body is preferably made from plastic, but alternatively may be made from metal.

Irrespective of the embodiment, the resin is deposited in the pairs of housings in a liquid state and then solidified such that, in the solidified state, the resin retains its shape and is able to transmit the connecting forces between the eye and the heddle body. The resin can also be deposited solidly with clearance in the housings, then heated in the housings, where it goes to the liquid state to extend in the housings, then solidified. In the solidified state, depending on the type of resin used, the resin may have a higher or lower hardness.

Within the meaning of the present invention, a resin is a natural, artificial or synthetic, thermoplastic or thermosetting polymer product, optionally with an added hardener or additive, such as solid reinforcements, for example in the form of fibers.

When the resin is placed and solidified in a pair of housings, the body of the formed assembly member is made up of a volume of the first housing of the pair of housings, a volume of the second housing of the pair of housings and a possible communication volume between those two volumes.

In all of the embodiments, due to the use of resin, part of the body and/or the head of an assembly member positioned in a first pair of housings can be a single piece with a portion of the body and/or the head of another assembly member positioned in a second pair of housings that is offset in the longitudinal direction relative to the first pair of housings. Furthermore, each housing is formed withdrawn from the lateral edge adjacent to the eye or the heddle body.

Within the meaning of the present invention, two housings are across from one another if they are at least partially facing one another and communicate with one another before the deposition of the resin. In particular, when two housings are across from one another in a given direction, the projections of the outlets of the housings of the pair of housings turned toward the other housing of the pair of housings in a plane perpendicular to the facing direction at least partially overlap.

The loom M is shown in FIG. 30 with heddles 1 according to the first embodiment. It can also be equipped with heddles 1001, 2001, 3001 and 1 of the other embodiments.

The invention is described above as it applies on a Jacquard-type loom. It is, however, applicable to heddles for frames or frame looms.

The embodiments and alternatives considered above may be combined with one another to create new embodiments.

The invention claimed is:

1. A heddle for guiding a warp yarn for a loom, the heddle extending lengthwise along a longitudinal axis and comprising:

a heddle body including at least one strand, and at least one eye including at least one housing and an eyelet for passage of the warp yarn, the heddle body includes at least one housing, and the housing of the eye and the housing of the heddle body extend along a common axis transverse to the longitudinal axis, the housing of the heddle body is across from the housing of the eye, these housings together forming a pair of housings that are open to one another, and an assembly member made from solidified resin is positioned in the pair of housings to thereby connect the heddle body and the at least one eye.

2. The heddle according to claim 1, wherein the assembly member made from solidified resin forms an obstacle that secures the strand and the eye along the longitudinal axis and along an axis perpendicular to the longitudinal axis and the transverse axis.

3. The heddle according to claim 1, wherein the housing of the heddle body and/or the housing of the eye crosses all the way through the heddle body or the eye, along the transverse axis.

4. The heddle according to claim 1, wherein the housing of the heddle body and/or the housing of the eye is a hole having a circular, oblong or polygonal section.

5. The heddle according to claim 1, wherein at least one housing of the eye or the heddle body is a notch arranged on an edge of the eye or the heddle body.

6. The heddle according to claim 1, wherein an assembly member of a first pair of housings forms a single piece with an assembly member of a second pair of housings, offset in the longitudinal direction relative to the first pair of housings.

7. The heddle according to claim 1, wherein the eyelet crosses through the eye along the transverse axis and the assembly member forms a rivet made up of a resin body extending along the transverse axis and at least one head.

8. The heddle according to claim 1, including at least two pairs of housings distributed along the longitudinal axis and each housing having a resin assembly member.

9. The heddle according to claim 8, wherein all of the pairs of housings of the heddle emerge on a common side on the outside of the heddle.

10. The heddle according to claim 1, wherein a portion of a first part, among the heddle body and the eye, is received in a receiving cavity arranged on a second part among the heddle body and the eye, while at least one housing, arranged on the second part for a resin assembly member, emerges in one of the receiving cavity or in a final portion that extends a bottom of the cavity in a direction of the longitudinal axis.

11. The heddle according to claim 10, wherein the cavity arranged on the second part for receiving the portion of the first part is defined between two side walls, a bottom and a ceiling.

12. The heddle according to claim 1, wherein at least the heddle body is made from a plastic material.

13. The heddle according to claim 12, wherein at least the heddle body is made from polyamide.

14. The heddle according to claim 1, including a heddle body with two separate strands, and an eye, in that one end of each strand includes a receiving cavity defined at least between two side walls and a bottom, as well as a final portion with no side wall, which extends the bottom in a direction of the longitudinal axis, a part with a reduced width of the eye being received in each cavity, and wherein a hole crossing through the final portion extending the bottom of each cavity is across from at least one through housing arranged on the eye to form a pair of housings for receiving the resin assembly member.

15. A loom equipped with a plurality of guide heddles for a warp yarn, wherein at least one heddle is according to claim 1.

16. A method for manufacturing a guide heddle comprising at least one strand with at least one housing, and an eye with at least one housing, wherein the method comprises at least the following steps:

a)—positioning the eye relative to the strand, such that the housings of the eye are across from the housings of the strand and form at least one pair of housings;

b)—placing a quantity of liquid resin in the pair of housings;

c)—hardening of the resin in the pair of housings.

* * * * *